US012565728B2

(12) United States Patent
Dillon

(10) Patent No.: US 12,565,728 B2
(45) Date of Patent: Mar. 3, 2026

(54) THERMAL IMAGING FOR TEMPERATURE MEASUREMENT IN WASHING MACHINES

(71) Applicant: Haier US Appliance Solutions, Inc., Wilmington, DE (US)

(72) Inventor: Nicholas Matthew Dillon, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 606 days.

(21) Appl. No.: 17/939,289

(22) Filed: Sep. 7, 2022

(65) Prior Publication Data

US 2024/0077361 A1 Mar. 7, 2024

(51) Int. Cl.

| | |
|---|---|
| ***D06F 34/24*** | (2020.01) |
| ***D06F 23/04*** | (2006.01) |
| ***D06F 33/34*** | (2020.01) |
| ***D06F 34/14*** | (2020.01) |
| ***D06F 39/04*** | (2006.01) |
| ***D06F 39/08*** | (2006.01) |
| *D06F 103/16* | (2020.01) |
| *D06F 105/10* | (2020.01) |

(52) U.S. Cl.

CPC ..... *D06F 34/24* (2020.02); *D06F 23/04* (2013.01); *D06F 33/34* (2020.02); *D06F 34/14* (2020.02); *D06F 39/04* (2013.01); *D06F 39/088* (2013.01); *D06F 2103/16* (2020.02); *D06F 2105/10* (2020.02)

(58) Field of Classification Search

CPC ..... D06F 23/04; D06F 34/14; D06F 34/24; D06F 39/04; D06F 39/088; D06F 2103/16; D06F 2105/10

See application file for complete search history.

(56) References Cited

U.S. PATENT DOCUMENTS

| | | | | |
|---|---|---|---|---|
| 10,060,063 | B2 | 8/2018 | Kim et al. | |
| 2006/0163372 | A1* | 7/2006 | Wiemer | G05D 23/1393 236/12.12 |
| 2012/0304395 | A1* | 12/2012 | Griswold | D06F 33/34 68/200 |

(Continued)

FOREIGN PATENT DOCUMENTS

| | | | |
|---|---|---|---|
| JP | 5246203 | B2 | 7/2013 |
| KR | 20130044764 | A | 5/2013 |
| WO | WO2020248960 | A1 | 12/2020 |

*Primary Examiner* — Joseph L. Perrin

(74) *Attorney, Agent, or Firm* — Dority & Manning, P.A.

(57) ABSTRACT

A washing machine appliance is provided. The washing machine appliance may include a wash tub, a wash basket rotatably mounted in the wash tub, and a water supply configured to provide wash fluid as a fluid stream that is collected in the wash tub as a fluid bath. The washing machine appliance may further include a thermal sensor configured to obtain data of the fluid stream. A controller of the washing machine may be in operational communication with the thermal sensor and the water supply. The controller may be configured to obtain a fluid temperature of the fluid stream using the thermal sensor, compare the fluid temperature to a preset temperature, and adjust the water supply in response to comparing the fluid temperature to the preset temperature. The controller may also obtain a temperature of the fluid bath. Methods of making and using the washing machine appliance are also provided.

19 Claims, 6 Drawing Sheets

(56) References Cited

U.S. PATENT DOCUMENTS

| | | | | |
|---|---|---|---|---|
| 2016/0060800 | A1* | 3/2016 | Ghosh | D06F 33/34 68/12.23 |
| 2017/0226679 | A1* | 8/2017 | De Bernardo | D06F 33/34 |
| 2019/0169780 | A1* | 6/2019 | Chen | G05B 19/0426 |
| 2019/0257023 | A1* | 8/2019 | Pollett | D06F 34/24 |
| 2019/0352836 | A1* | 11/2019 | Boutiette | D06F 39/088 |
| 2020/0071871 | A1 | 3/2020 | Kim et al. | |
| 2021/0360752 | A1* | 11/2021 | Parhar | H05B 6/6447 |
| 2023/0121501 | A1* | 4/2023 | Choi | D06F 58/38 34/550 |

* cited by examiner

THERMAL IMAGING FOR TEMPERATURE MEASUREMENT IN WASHING MACHINES

FIELD OF THE INVENTION

The present subject matter relates generally to washing machine appliances, and more particularly to temperature measurements in washing machine appliances.

BACKGROUND OF THE INVENTION

Washing machine appliances generally have a cabinet with a tub and a wash basket disposed within the tub. The wash basket may be configured to rotate within the tub. During washing operation, fluid is added to the tub, filling a portion of the tub and a portion of the wash basket.

Challenges exist in controlling the fluid temperature during washing operation. Water entering the washing machine appliance may vary in temperature, as water used to fill washing machine appliances generally varies in temperature depending on location and/or user settings (e.g., water heater settings and/or tap water sources). The ability to regulate fluid temperature is important to have best wash performance. Proper fluid temperature is desirable to properly remove soil and some stains from articles, including clothing, washed in a washing machine. Incorrect water temperature may set stains on articles, sometimes making them irremovable.

Accordingly, a system to better monitor and control the temperature of wash fluids would be beneficial. Further, a method of determining the temperature of wash fluids in wash baskets would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine is provided. The washing machine may include a cabinet defining an opening, a door, a wash tub, a wash basket, a water supply, a thermal sensor, and a controller. The door may be configured for selective access to the cabinet by way of the opening. The wash tub may be located within the cabinet. The wash basket may be rotatably mounted within the wash tub. The wash basket may have a basket bottom. The water supply may be configured to provide wash fluid as a fluid stream that is collected in the wash tub as a fluid bath. The thermal sensor may be configured to obtain temperature data of the fluid stream. The controller may be in operational communication with the thermal sensor and the water supply. The controller may be configured to obtain a fluid temperature of the fluid stream using the thermal sensor, compare the fluid temperature to a preset temperature, and adjust the water supply in response to comparing the fluid temperature to the preset temperature.

In another exemplary aspect of the present disclosure, a washing machine fluid temperature measurement method is provided. The method may be for measuring fluid entering a wash tub of a washing machine appliance in a fluid stream. The wash tub may house a wash basket therein. The method may include the steps of obtaining a fluid temperature of the fluid stream using a thermal sensor directed at the fluid stream, comparing the fluid temperature to a preset temperature, and adjusting the water supply to the wash basket in response to comparing the fluid temperature to the preset temperature.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Use of the same or similar reference numerals in the figures denotes the same or similar features unless the context indicates otherwise.

DETAILED DESCRIPTION

Figure 1:
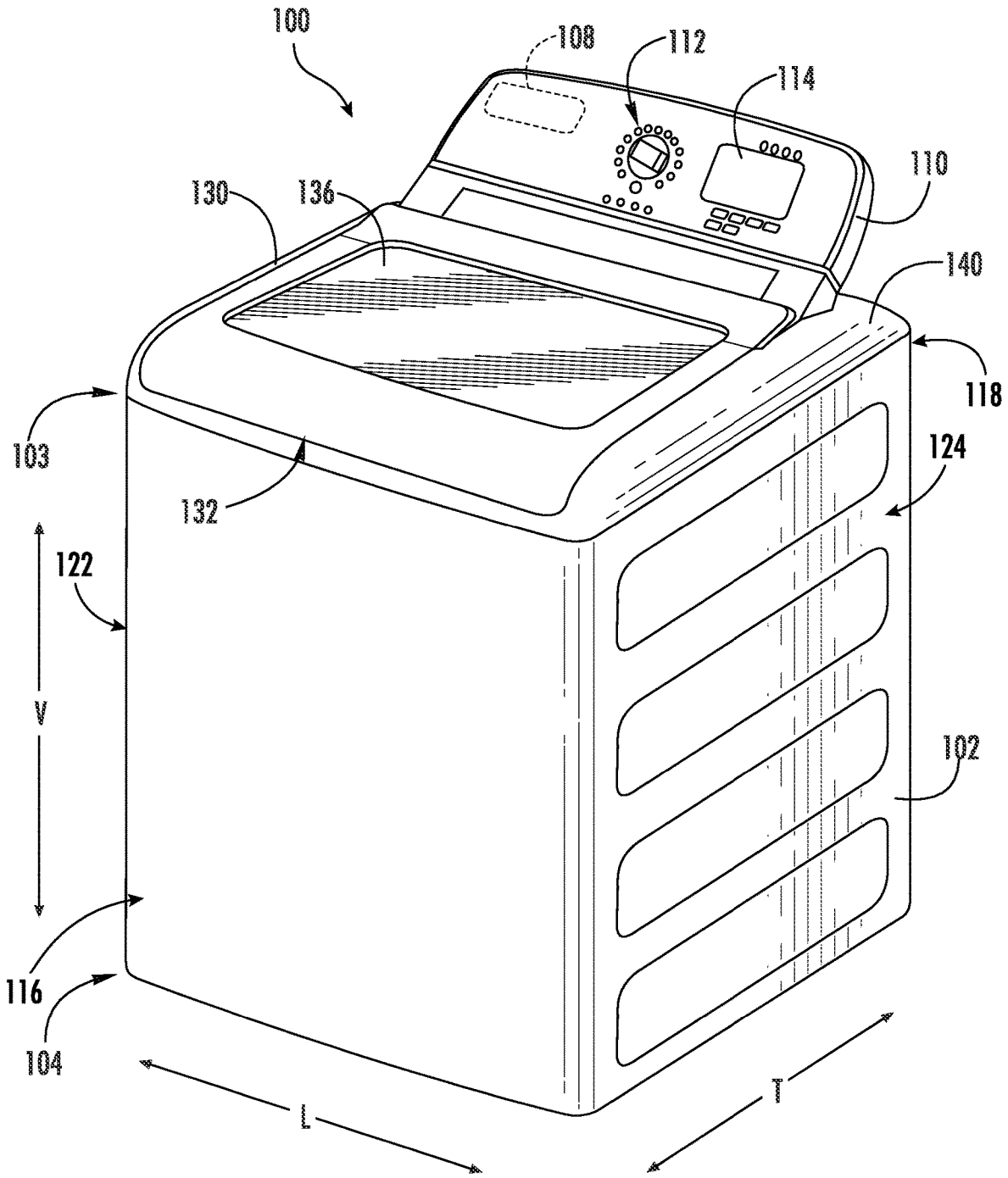
FIG. 1 provides a perspective view of a top load washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. Terms such as "inner" and "outer" refer to relative directions with respect to the interior and exterior of the washing machine appliance, and in particular the chamber(s) defined therein. For example, "inner" or "inward" refers to the direction towards the interior of the washing machine appliance. Terms such as "left," "right," "front," "back," "top," or "bottom" are used with reference to the perspective of a user accessing the appliance (e.g., when the door is in the closed position). For example, a user stands in front of the appliance to open a door and reaches into the internal chamber(s) to access items therein.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as clockwise or counterclockwise, with the vertical direction V).

The present invention advantageously provides a washing machine appliance that may provide temperature control to fluids entering the washing machine for improved wash performance. A temperature sensor, such as an infrared camera, may provide temperature data to a controller to actively monitor fluid temperatures of fluid entering washing machine appliance. In some embodiments, the fluid temperature monitoring may allow fluid entering the washing machine appliance to be brought to a preset temperature. Advantageously, washing items in a washing machine where the fluids for washing are at a present temperature may provide improved conditions for improved washing of articles. For example, stains may be removed more readily when washed in a preset temperature as determined by embodiments described herein.

Figure 2:
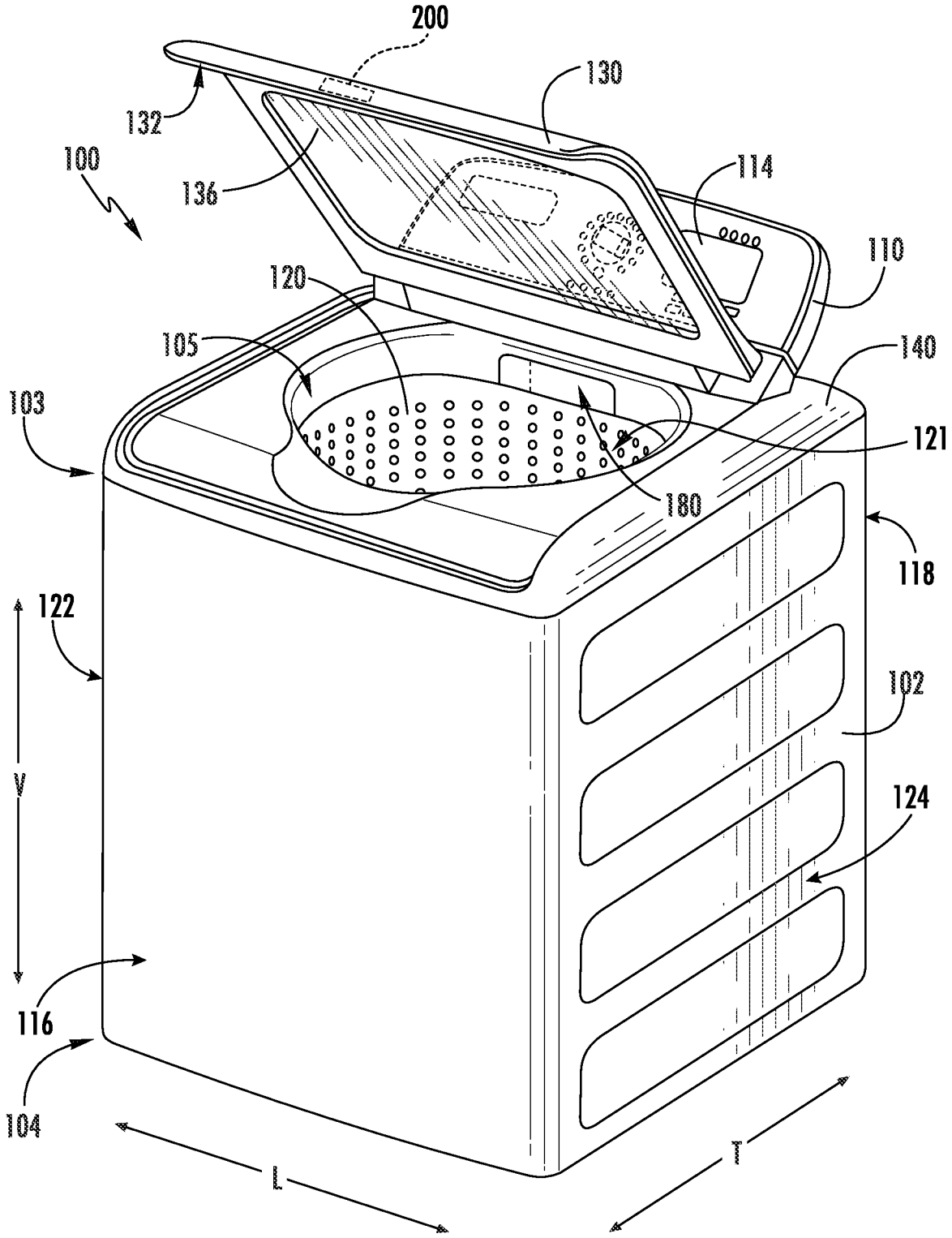
FIG. 2 provides a perspective view of the exemplary washing machine appliance of FIG. 1 in an open position according to exemplary embodiments of the present disclosure.

Turning now to the figures, FIGS. 1 and 2 illustrate an exemplary embodiment of a washing appliance. Specifically, the washing appliance is illustrated as a vertical axis washing machine appliance 100. In FIG. 1, a lid or door 130 is shown in a closed position. In FIG. 2, door 130 is shown in an open position. Washing machine appliance 100 generally defines a vertical direction V, a lateral direction L, and a transverse direction T, each of which is mutually perpendicular, such that an orthogonal coordinate system is defined.

While described in the context of a specific embodiment of vertical axis washing machine appliance 100, using the teachings disclosed herein it will be understood that vertical axis washing machine appliance 100 is provided by way of example only. Other washing appliances having different configurations, different appearances, or different features may also be utilized with the present subject matter as well (e.g., horizontal axis washing machines).

Washing machine appliance 100 has a cabinet 102 that extends between a top portion 103 and a bottom portion 104 along the vertical direction V. A wash basket 120 is rotatably mounted within cabinet 102. A motor (not shown) may be in mechanical communication with wash basket 120 to selectively rotate wash basket 120 (e.g., about a rotation axis during an agitation or a rinse cycle of washing machine appliance 100). Wash basket 120 is received within a wash tub 121 and is configured for receipt of articles for washing. Wash tub 121 may house the wash basket 120 therein. Wash basket 120 is rotatably mounted within wash tub 121. Wash basket 120 has a basket bottom 126. The wash tub 121 holds wash and rinse fluids for agitation in wash basket 120 within wash tub 121.

In optional embodiments, an agitator or impeller (not shown) extends into wash basket 120 and is also in mechanical communication with the motor. The impeller may assist agitation of articles disposed within wash basket 120 during operation of washing machine appliance 100.

Cabinet 102 of washing machine appliance 100 may have a front panel 116, a rear panel 118, a left panel 122, and a right panel 124. In some embodiments, cabinet 102 of washing machine appliance 100 has a top panel 140. Top panel 140 defines an opening 105 that permits user access to wash basket 120 of wash tub 121. Door 130, which may be rotatably mounted to top panel 140, permits selective access to opening 105. Door 130 is configured for selective access to cabinet 102 by way of opening 105. In particular, door 130 selectively rotates between the closed position shown in FIG. 1 and the open position shown in FIG. 2. In the closed position, door 130 inhibits access to wash basket 120. Conversely, in the open position, a user can access wash basket 120. In optional embodiments, a window 136 in door 130 permits viewing of wash basket 120 when door 130 is in the closed position (e.g., during operation of washing machine appliance 100). Door 130 also includes a handle 132 that, for example, a user may pull or lift when opening and closing door 130. Further, although door 130 is illustrated as mounted to top panel 140, alternatively, door 130 may be mounted to another portion of cabinet 102 or any other suitable support.

In certain embodiments, a control panel 110 with at least one input selector 112 extends from top panel 140. Control panel 110 and input selector 112 collectively form a user interface input for operator selection of machine cycles and features. A display 114 of control panel 110 indicates selected features, operation mode, a countdown timer, or other items of interest to appliance users regarding operation. Operation of washing machine appliance 100 may be controlled by a controller or processing device 108 connected (e.g., electrically coupled) to control panel 110 for user manipulation to select washing machine cycles and features. In response to user manipulation of control panel 110, controller 108 operates the various components of washing machine appliance 100 to execute selected machine cycles and features.

Controller 108 may include a memory (e.g., non-transitive media) and microprocessor, such as a general or special purpose microprocessor operable to execute programming instructions or micro-control code associated with a selected machine cycles and features (e.g., as part of a washing operation). The memory may represent random access memory such as DRAM or read only memory such as ROM or FLASH. In certain embodiments, the processor executes programming instructions stored in memory. The memory may be a separate component from the processor or may be included onboard within the processor. Alternatively, controller 108 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 110 and other components of washing machine appliance 100 (e.g., one or more sensors, such as a pressure sensor mounted to wash tub 121) may be in communication with controller 108 via one or more signal lines or shared communication busses.

In some embodiments, during operation of washing machine appliance 100, laundry items are loaded into wash basket 120 through opening 105, and a washing operation is initiated through operator manipulation of input selectors 112. Wash basket 120 or wash tub 121 is filled with water and detergent or other fluid additives via an additive dispenser 180. One or more valves can be controlled by washing machine appliance 100 to provide for filling wash basket 120 to the appropriate level for the volume or number of articles being washed or rinsed. By way of example for a wash cycle, once wash tub 121 is properly filled with fluid, the contents of wash tub 121 can be agitated (e.g., with an impeller as discussed previously) for washing of laundry items in wash basket 120.

After the agitation phase of the wash cycle is completed, wash tub 121 can be drained. Laundry articles can then be rinsed (e.g., for a rinse cycle) by again adding fluid to wash basket 120 depending on the specifics of the washing operation selected by a user. The impeller may again provide agitation within wash basket 120. One or more spin cycles also may be used. In particular, a spin cycle may be applied after the wash cycle or after the rinse cycle to wring wash fluid from the articles being washed. During a spin cycle, wash basket 120 is rotated at relatively high speeds. After articles disposed in wash basket 120 are cleaned or washed, the user can remove the articles from wash basket 120 (e.g., by reaching into wash basket 120 through opening 105).

Figure 3:
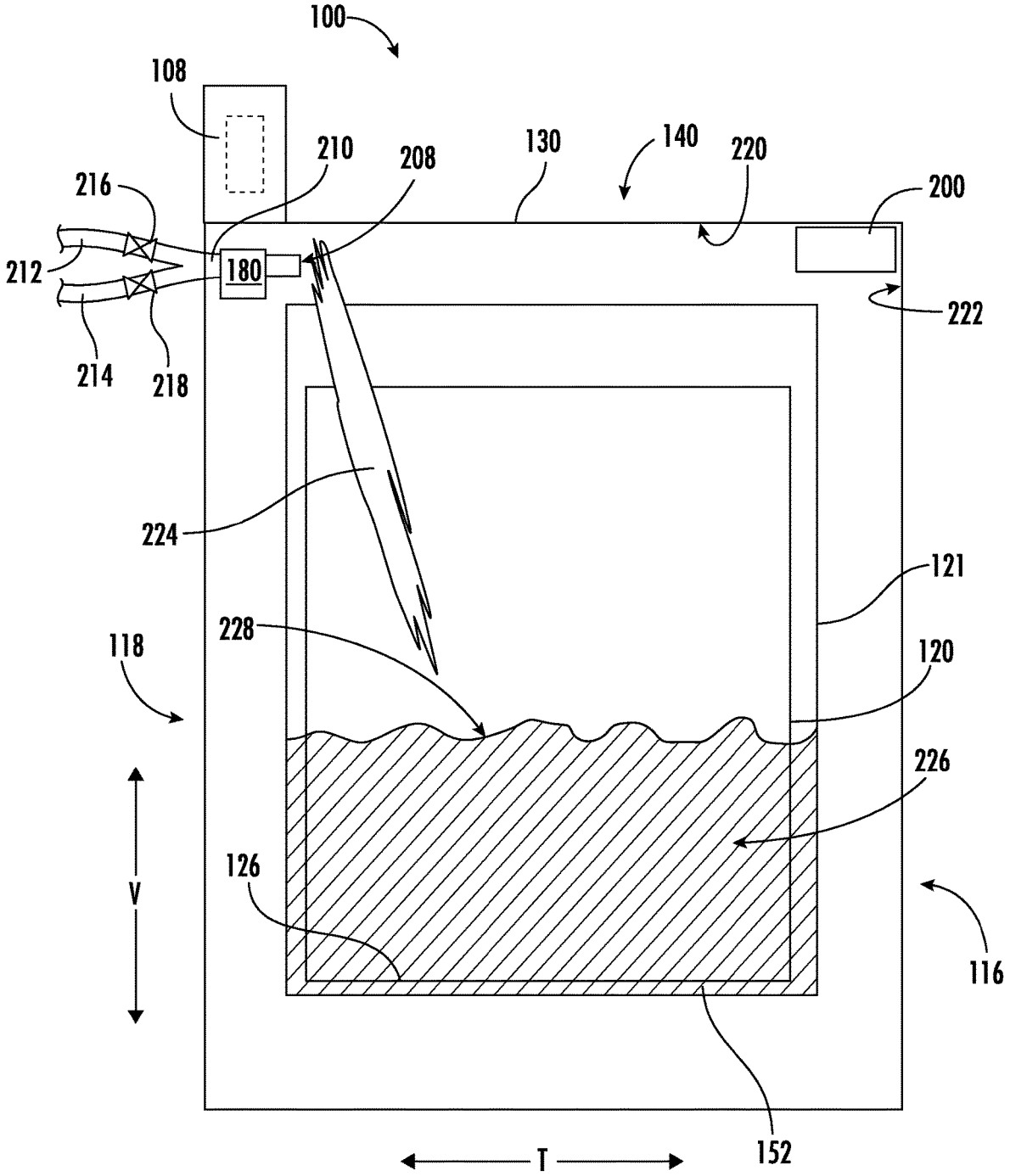
FIG. 3 provides a side, cross-sectional view of the exemplary washing machine appliance of FIG. 1 in the closed position according to exemplary embodiments of the present disclosure.
Figure 4:
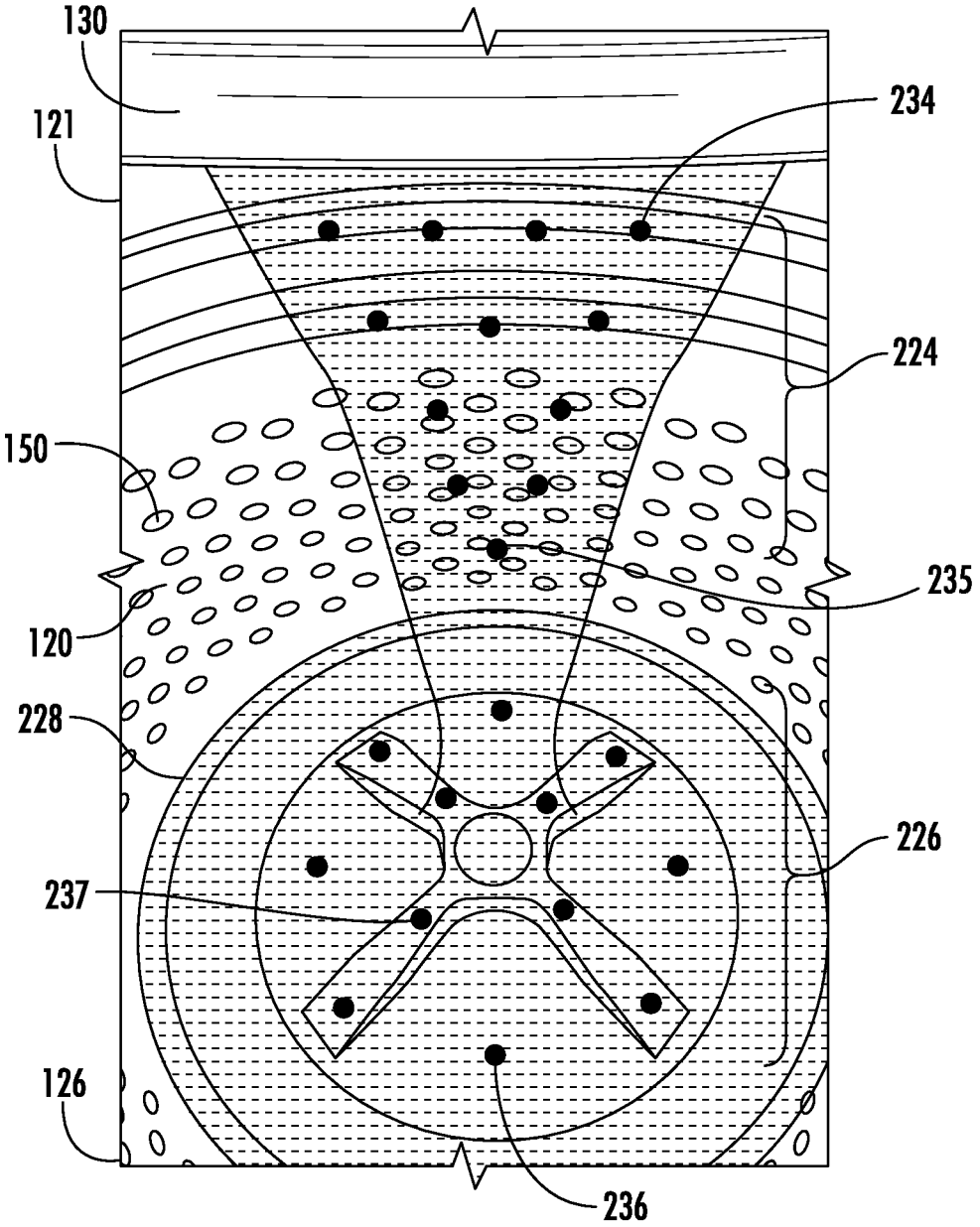
FIG. 4 provides a perspective view of a wash basket of the exemplary washing machine appliance of FIG. 1 in an open according to exemplary embodiments of the present disclosure.
Figure 5:
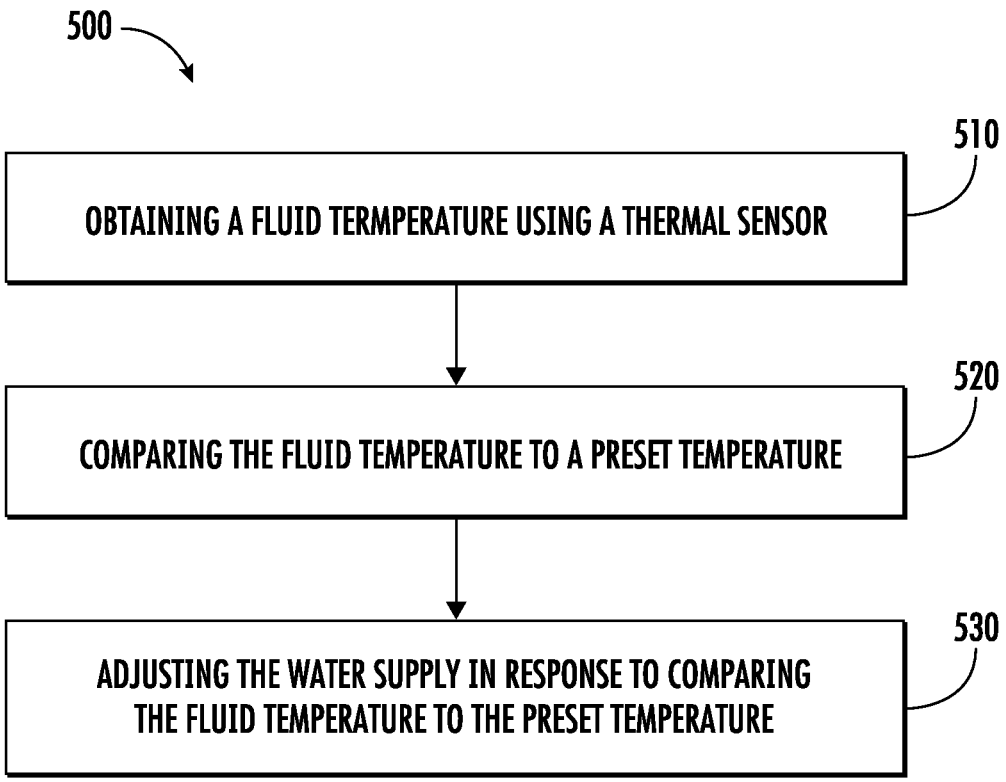
FIG. 5 provides a flow chart illustrating a method of temperature control during operation of an exemplary washing machine appliance.

Turning to FIGS. 3 through 5, washing machine appliance 100 may include a water supply line 210. Water supply line 210 may provide or direct a flow of water from a water supply source (such as a municipal water supply 210) into additive dispenser 180 and into wash tub 121. Water supply line 210 may include a spout 208 that opens water supply line 210 into wash basket 120, generating a fluid stream 224 into wash basket 120 and wash tub 121. In this manner, water supply line 210 may generally be operable to supply water into additive dispenser 180 to generate a wash fluid, e.g., for use in a wash cycle, or a flow of fresh water, e.g., for a rinse cycle. It should be appreciated that water supply line 210 may be positioned at any other suitable location within cabinet 102. In addition, although water supply line 210 is described herein as regulating the flow of "wash fluid," it should be appreciated that this term includes, water, detergent, other additives, or some mixture thereof.

As shown in FIG. 3, water supply line 210 supplies fluid from additive dispenser 180, through spout 208, and into wash basket 120. Fluid may flow out of spout 208 as a fluid stream 224. Fluid may flow into wash tub 121, forming a fluid bath 226. Thus, a water supply (e.g., from water supply line 210) may be configured to provide wash fluid as a fluid stream, the wash fluid collected in wash tub 121 as a fluid bath 226. As used herein, the term "fluid stream" is generally intended to refer to the flow of wash fluid being provided into wash basket 120 before the flow reaches basket bottom 126. In other words, "fluid stream" includes wash fluid falling with the force of gravity between spout 208 and fluid bath 226. Fluid stream 224 is directed toward basket bottom 126. Fluid stream 224 may further touch basket bottom 126 until fluid level 228 in wash tub 121 is above basket bottom 126. Fluid accumulating in wash tub 121 may form a fluid bath 226 in wash tub 121 when fluid level 228 is above basket bottom 126.

Water supply line 210 may connect to a hot water line 212 and to a cold water line 214. As shown in FIG. 3, hot water line 212 has a hot water valve 216 and cold water line 214 has a cold water valve 218. Controller 108 may be in operative communication with hot water valve 216 and cold water valve 218 to open each valve or to turn each valve on to allow water to flow into the washing machine appliance 100 (e.g., into wash tub 121). For example, controller 108 may be configured to adjust the water supply 210 by turning on the hot water valve 216. According to the arrangement, controller 108 may be configured to adjust the water supply 210 by turning on the cold water valve 218. According to alternative embodiments, any other suitable mixing valve or system of valves may be used to dispense the wash fluid at a desired temperature.

Washing machine appliance 100 may further include a thermal sensor 200. Thermal sensor 200 may be configured to obtain temperature data of the fluid stream 224. In some embodiments, thermal sensor 200 may be located on an inner surface 220 of door 130. In some embodiments, thermal sensor 200 may be located on an inner surface 222 of cabinet 102. As shown in FIG. 3, thermal sensor 200 is directed toward fluid stream 224 and basket bottom 126 or fluid bath 226. Thermal sensor 200 may be configured to have a field of view wide enough to include both fluid stream 224 and fluid bath 226 in it. During use, thermal sensor 200 may also be directed toward fluid bath 226 and fluid level 228 when fluid level 228 is above basket bottom 126. Controller 108 may be in operational communication with thermal sensor 200.

Thermal sensor 200 may be configured to obtain temperature data of fluid within wash basket 120. Thermal sensor 200 may obtain temperature data of fluid stream 224 and/or of fluid bath 226. In some embodiments, thermal sensor 200 may be configured to obtain a plurality of thermal values of fluid stream 224 and/or thermal values of fluid bath 226.

Additionally or alternatively, thermal sensor 200 may be an infrared camera, an infrared sensor, or another sensor for detecting temperatures. Thermal sensor 200 may be configured to detect temperatures indirectly or remotely. For example, thermal sensor 200 may be located proximate to front panel 116 and may detect temperatures of fluid stream 224 located proximate to rear panel 118. Thermal sensor 200 may be configured to obtain thermal images or video of fluid stream 224 and inside of wash basket 120. Controller 108 may use the images or video to determine temperatures.

As shown in FIG. 4, thermal sensor 200 may obtain temperature data representing a plurality of temperature values for a plurality of locations (e.g., stream location 234 or fluid bath location 236) along fluid stream 224. Thermal sensor 200 may obtain temperature data representing a plurality of temperature values for a plurality of locations of fluid bath 226 when fluid level 228 is above basket bottom 126. The plurality of locations of the fluid bath 226 may be along fluid level 228 in some examples.

In some embodiments, the plurality of temperature values may include between about 3 and 10 values, each temperature value representing the temperature of fluid stream 224 at a unique position along fluid stream 224 (e.g., fluid stream location 234). In some embodiments, the plurality of temperature values may include between about 3 and 10 values, each temperature value representing the temperature of fluid bath 226, or rather fluid level 228 above basket bottom 126, at a unique position of the fluid bath 226 (e.g., fluid bath location 236 or fluid bath location 237).

In some embodiments, temperature values for either fluid bath locations (e.g., fluid bath locations 236, 237) or fluid stream locations (e.g., fluid stream locations 234, 235) may include temperatures for between about 1 and 25 sample locations. For example, temperature values may be obtained at different locations within the fluid bath 226 within the field of view of thermal sensor 200, such as the example fluid bath locations 236 and 237, and temperature values may be obtained for different locations within the fluid stream 224, such as the example fluid stream locations 234, and 235. In some embodiments, temperature values for either fluid bath locations or fluid stream locations may include temperatures for between about 2 and 20 sample locations. In some embodiments, temperature values for either fluid bath locations or fluid stream locations may include temperatures for between about 2 and 15 sample locations.

As shown in FIG. 4, as fluid level 228 rises, temperature data from thermal sensor 200 along basket bottom 126 may represent temperatures of the fluid bath 226 along the fluid level 228. In other words, thermal sensor 200 may detect the top surface temperature of fluid bath 226 as fluid bath 226 rises, when fluid level 228 is above basket bottom 126. In other words, temperature data of fluid bath 226 may be used to describe the location the thermal sensor 200 is directed towards, the thermal sensor 200 detecting the temperature of whatever component or components are above basket bottom 126, such as fluid level 228 of fluid bath 226.

Temperature data received by controller 108 from thermal sensor 200 may be in the form of at least one thermal image. For example, if thermal sensor 200 is an infrared camera, thermal images of interior of wash basket 120, including fluid stream 224, basket bottom 126, fluid bath 226, and/or fluid level 228, may be received by controller 108. Controller 108 may use thermal images received to determine temperature values for fluid stream locations (e.g., fluid stream locations 234, 235) and/or fluid bath locations (e.g., fluid bath locations 236, 237).

Figure 6:
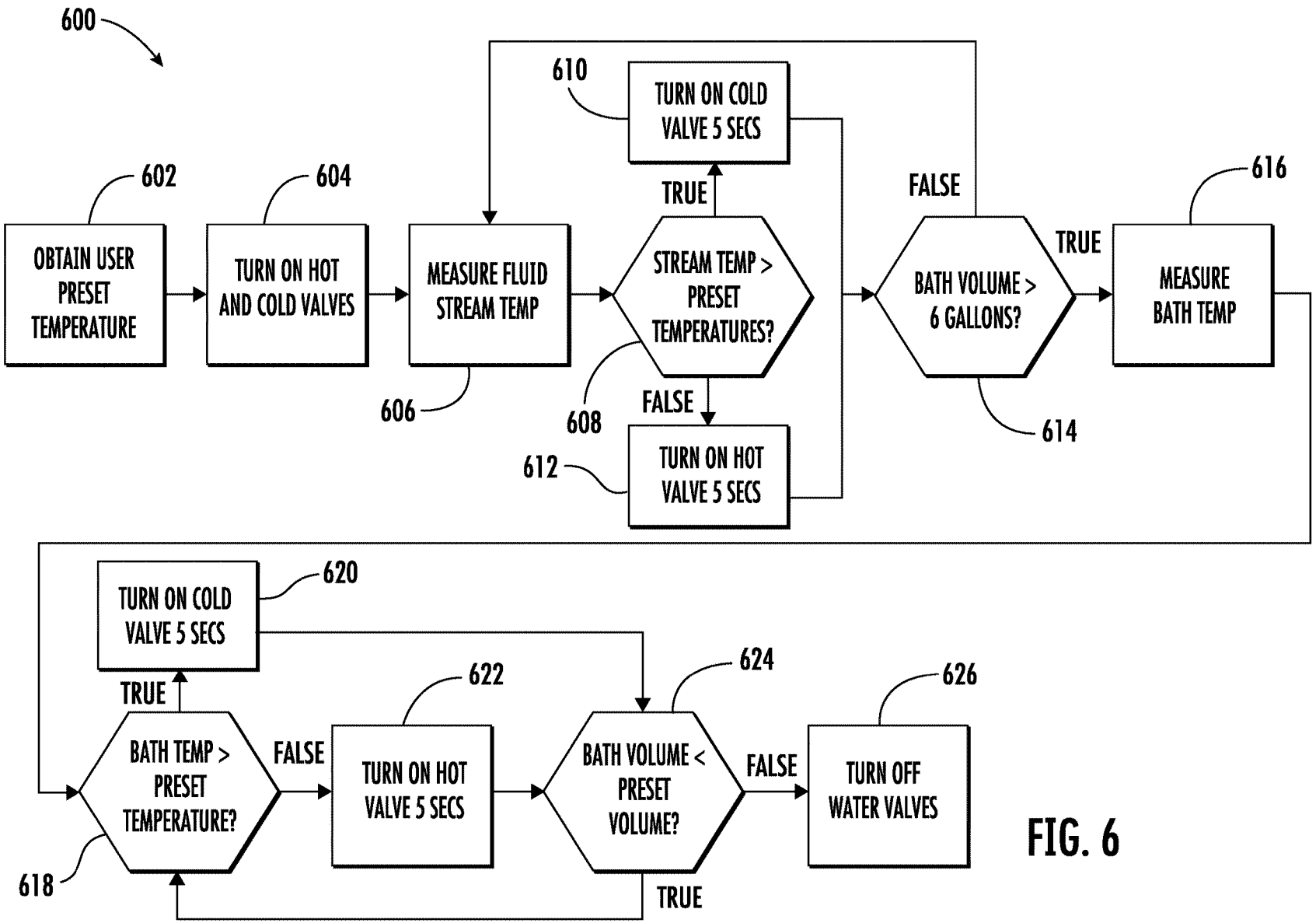
FIG. 6 provides a flow chart illustrating an example method of temperature control during operation of an exemplary washing machine appliance.

Referring now to FIGS. 5 and 6, various methods (e.g., method 500) may be provided for use with thermal sensor 200 in accordance with the present disclosure. In some embodiments, all, or some of the various steps of the method(s) may be performed by a suitable controller (e.g., controller 108). Thus, controller 108 may be configured to direct such a method (e.g., as or as part of an item-management operation). During such methods, controller 108 may receive inputs and transmit outputs from various other portions of the washing machine appliance 100. For example, controller 108 may send signals to and receive signals from thermal sensor 200 or water supply 210, including water valves 216, 218. The present methods may advantageously provide bath fluids at a preset temperature to the wash tub 121 for washing operations of the washing machine appliance 100. For instance, the disclosed methods may advantageously provide washing temperatures to have improved removal of stains or improved conditions for washing articles in the washing machine appliance 100. The preset temperature may vary to accommodate different articles or different stains.

FIGS. 5 and 6 depict steps performed in a particular order for purpose of illustration and discussion. Those of ordinary skill in the art, using the disclosures provided herein, will understand that (except as otherwise indicated) the steps of any of the methods disclosed herein can be modified, adapted, rearranged, omitted, or expanded in various ways without deviating from the scope of the present disclosure.

At step 510, a method 500 includes obtaining a fluid temperature of the fluid stream 224 using thermal sensor 200. Controller 108 may obtain the fluid temperature using thermal sensor 200. Thermal sensor 200 may be directed at the fluid stream 224. In some examples, thermal sensor 200 may further be directed at basket bottom 126 to obtain a fluid temperature of fluid bath 226.

Controller 108 may be configured to receive temperature data from thermal sensor 200 as part of the step of obtaining the fluid temperature. In some embodiments, controller 108 is further configured to obtain the fluid temperature by analyzing the temperature data. In some embodiments, controller 108 further obtains the fluid temperature by analyzing the temperature data to determine at least two temperature values for the fluid stream 224 and average the at least two temperature values of the fluid stream to determine the fluid temperature. For example, the temperature of the fluid stream at fluid stream locations 234, 235 may be averaged to determine the fluid temperature.

In some examples, controller 108 is further configured to obtain the fluid temperature by analyzing the temperature data to determine between about three and ten temperature values for the fluid stream 224 or the fluid bath 226. For example, controller 108 may receive a thermal image from thermal sensor 200 and determine a plurality of temperature values from that thermal image. The plurality of temperature values may come from the areas of the thermal image that depict the fluid stream 224 and/or the fluid bath 226. In some examples, the thermal image may depict a similar area of the wash basket 120, fluid stream 224, and fluid bath 226 as that shown in FIG. 4. As described herein, more, or fewer temperature values may be determined by controller 108, depending on the needs of the embodiments.

The controller 108 may further be configured to use the temperature values for the fluid stream 224 or the fluid bath 226 to determine the fluid temperature. Additionally or alternatively, the controller 108 may be further configured to obtain the fluid temperature by computing an average fluid temperature from a plurality of temperature values received by the thermal sensor 200. For example, controller 108 may calculate an average of the temperature values at various locations of the fluid stream 224 (e.g., as shown in FIG. 4) to determine the fluid temperature. In some examples, controller 108 may calculate an average of the temperature values at various locations of the fluid bath 226 (e.g., as shown in FIG. 4) to determine the fluid temperature. In some embodiments, controller 108 may calculate an average of the temperature values at various locations of both fluid stream 224 and fluid bath 226 to determine the fluid temperature.

During use, the controller 108 may be configured to determine that fluid level 228 of fluid bath 226 is below basket bottom 126. Controller 108 may further be configured to obtain the fluid temperature of fluid stream 224 when a fluid level 228 is below basket bottom 126. At the beginning of filling the wash tub 121, fluid flows into the wash basket 120, through perforations 150 (as shown in FIG. 4) in the wash basket 120, and into a sump 152 of the wash tub 121 (as shown in FIG. 3). The fluid level 228 is therefore below the basket bottom 126 when fluid begins to flow in fluid stream 224. Temperature values from the basket bottom 126 location when fluid begins to flow in fluid stream 224 would be of the wash basket 120, not of fluid bath 226 within wash tub 121. Thus, the fluid temperature may be determined from temperature data of fluid stream 224 alone when the fluid level 228 is below the basket bottom 126.

In this manner, controller 108 may be configured to determine that fluid level 228 of fluid bath 226 is above basket bottom 126. Controller 108 may further be configured to obtain the fluid temperature of fluid bath 226 when a fluid level 228 is above the basket bottom 126. In some embodiments, when the fluid level 228 is above the basket bottom 126, temperature values may be used from the fluid bath 226 location to determine the fluid temperature.

In some examples, controller 108 may use temperature data of fluid stream 224 and fluid bath 226 to determine the fluid temperature. For example, controller 108 may determine that fluid level 228 of fluid bath 226 is above basket bottom 126 and obtain the fluid temperature by averaging the temperature data of the fluid stream 224 and the temperature data of the fluid bath 226. Additionally or alternatively, controller 108 may determine that fluid level 228 of fluid bath 226 is above basket bottom 126 and may obtain the fluid temperature by averaging a plurality of temperature values of the fluid bath 226 and a plurality of temperature values of the fluid stream 224.

For example, obtaining the fluid temperature using thermal sensor 200 may further include determining that fluid level 228 of fluid bath 226 is below basket bottom 126, and receiving temperature data for more than one location along fluid stream 224. Controller 108 may receive temperature data for more than one location along fluid stream 224. Additionally or alternatively, obtaining the fluid temperature using thermal sensor 200 may further include determining that fluid level 228 of fluid bath 226 is above basket bottom 126, and receiving temperature data for more than one location of fluid bath 226. Controller 108 may receive temperature data for more than one location along fluid bath 226. Controller 108 may also determine whether fluid level 228 is above or below basket bottom 126, as will be discussed in more detail below.

According to the arrangement, the controller 108 may be further configured to obtain the fluid temperature by computing an average fluid temperature from a plurality of temperature values of the fluid stream 224 when fluid level 228 is below basket bottom 126 and by computing the average fluid temperature from a plurality of temperature values of fluid bath 226 when fluid level 228 is above basket bottom 126. The fluid temperature may be an average fluid temperature.

In additional or alternative embodiments, the fluid temperature may be determined using a mean fluid temperature calculation, a mode fluid temperature calculation, a weighted average calculation technique, a fluid temperature calculated using statistical representation or analysis, or other statistical analysis of temperature data to determine the fluid temperature. In this manner, outlier temperature readings may be determined and excluded from fluid temperature calculations using regular statistical modeling practices.

In some embodiments, the fluid temperature may be determined using both the temperature values from fluid stream 224 and the temperature values from fluid bath 226 when fluid level 228 is above basket bottom 126. For example, an average or a weighted average of the temperature values from both locations may be used to determine the fluid temperature.

According to the arrangement, controller 108 may be further configured to obtain the fluid temperature by computing an average fluid temperature from a plurality of temperature values of the fluid stream 224 when fluid level 228 is below basket bottom 126 and by computing the average fluid temperature from a plurality of temperature values of fluid bath 226 when fluid level 228 is above basket bottom 126.

At step 520, method 500 includes comparing the fluid temperature to a preset temperature. Controller 108 may compare the fluid temperature to a preset temperature. In some embodiments, the preset temperature may be received from a user using control panel 110 or input selector 112. In some embodiments, the preset temperature may be a temperature determined based on the settings selected, e.g., by receiving a selected setting from input selector 112 or control panel 110, for a particular wash operation of washing machine appliance 100.

At step 530, the method 500 includes adjusting water supply 210 in response to comparing the fluid temperature to the preset temperature. Controller 108 may adjust water supply 210 by adjusting at least one water valve (e.g., hot water valve 216 or cold water valve 218).

In some examples, controller 108 is further configured to adjust water supply 210 in response to comparing the fluid temperature to a preset temperature value by turning on cold water valve 218 when the fluid temperature is above the preset temperature value. In turn, controller 108 may be further configured to adjust water supply 210 in response to comparing the fluid temperature to the preset temperature by turning on hot water valve 216 when the fluid temperature is below the preset temperature value.

In some examples, if the fluid temperature is at the preset temperature value, controller 108 may maintain the configuration of the at least one water valve (e.g., hot water valve 216 and cold water valve 218).

FIG. 6 depicts an example flow chart 600 of a method of measuring fluid temperature in washing machine appliance 100. Controller 108 may perform the example method depicted in flow chart 600. At step 602, controller 108 obtains the preset temperature. Controller 108 may receive the preset temperature from a user using control panel 110 or input selector 112.

At step 604, controller 108 may turn on hot water valve 216 and cold water valve 218, to begin filling wash tub 121. At step 606, controller 108 may measure the fluid stream temperature of fluid stream 224. Controller 108 may use thermal sensor 200 to determine the fluid stream temperature as described herein.

At step 608, the fluid stream temperature is compared to the preset temperature to determine if the fluid stream temperature is greater than the preset temperature. If the fluid stream temperature is greater than the preset temperature, cold water valve 218 is completely opened for a predetermined period of time. At step 610, cold water valve 218 is turned on for a period of about 5 seconds. The predetermined period of time may be less than 5 seconds in some examples. In some examples, the predetermined period of time may be less than about one minute. Different time periods may be used in different embodiments including a variant time period depending on how far the fluid stream temperature is from the preset temperature. If the fluid stream temperature is not greater than the preset temperature, hot water valve 216 may be completely opened for a predetermined period of time. At step 612, hot water valve 216 is turned on for the predetermined period of time (e.g., about 5 seconds).

At step 614, the bath fluid volume of fluid bath 226 is measured. If the bath fluid volume is measured as less than an amount placing fluid level 228 below basket bottom 126, controller 108 returns to step 606. If the bath fluid volume is measured more than an amount placing fluid level 228 above basket bottom 126, controller 108 moves to step 616.

In the example flow chart 600, the volume of about 6 gallons is the amount of fluid bath 226 to have fluid level 228 above basket bottom 126. In some embodiments, the required volume may be more or less, depending on the size of wash tub 121 and the placement of wash basket 120 in wash tub 121.

The bath fluid volume may be measured using a physical measurement, such as a pressure sensor, or another sensor as would be understood. The bath fluid volume may be measured by a fluid flow time measurement, where the amount of fluid entering wash tub 121 is determined by the flow rate of fluid stream 224 and the time passed since controller 108 turned on water valves 216, 218.

At step 616, controller 108 measures the fluid temperature. Thermal sensor 200 may be used to determine the fluid temperature.

At step 618, the fluid temperature is compared to the preset temperature to determine if the fluid temperature is greater than the preset temperature. If the fluid temperature is greater than the preset temperature, cold water valve 218 is completely opened for a predetermined period of time. At step 620, cold water valve 218 is turned on for a period of about 5 seconds. The predetermined period of time may be less than 5 seconds in some examples. In some examples, the predetermined period of time may be less than about one minute. Different time periods may be used in different embodiments including a variant time period depending on how far the fluid temperature is from the preset temperature.

If the fluid temperature is not greater than the preset temperature, hot water valve 216 is completely opened for a predetermined period of time. At step 622, hot water valve 216 is turned on for the predetermined period of time (e.g., about 5 seconds).

At step 624, the bath fluid volume is measured, using any method as described herein or as otherwise known in the art. If the bath fluid volume is less than a volume setpoint, controller 108 returns to step 618. If the bath fluid volume is greater than or equal to the volume setpoint, controller 108 proceeds to step 626. At step 626, controller 108 turns off hot water valve 216 and cold water valve 218.

The volume setpoint may be a predetermined volume bath fluid, or a predetermined volume of fluid to fill the wash tub 121, as desired to proceed with washing machine operation, depending on the embodiments.

Embodiments described herein may include measuring water temperatures in the washing machine appliance by using the thermal imaging camera (infrared camera). In some examples, an infrared (IR) camera may be mounted on a washing machine appliance and may be directed towards a water fill nozzle and the bottom of the wash basket. Infrared camera mounting locations may be inside the washing machine structure or on the underside of the lid. The infrared camera may be set to take images at predetermined intervals or to take a video to monitor temperatures in real-time.

Temperatures received from the infrared camera can be fed into a temperature control algorithm that may be geared towards reaching a predetermined bath temperature. Measurements may be taken at multiple points in a water stream entering the wash basket or bath fluid within the wash basket to get an average stream temperature or an average bath fluid temperature. If the stream temperature is greater than the setpoint, the cold valve may be activated for a time interval (e.g., for about 5 seconds or less), or else the hot valve may be activated for a time interval, (e.g., for about 5 seconds or less). If the bath volume is greater than 6 gallons, the bath temperature may be measured. If the bath temperature is greater than the setpoint, the cold valve may be activated for a time interval (e.g., for about 5 seconds or less), or else the hot valve may be activated for a time interval (e.g., for about 5 seconds or less). Generally, bath fluid temperature may be controlled to achieve improved wash performance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet defining an opening;

a door configured for selective access to the cabinet by way of the opening;

a wash tub located within the cabinet;

a wash basket rotatably mounted within the wash tub, the wash basket having a basket bottom;

a water supply configured to provide wash fluid as a fluid stream that is collected in the wash tub as a fluid bath;

a thermal sensor configured to obtain temperature data of the fluid stream or the fluid bath, wherein the thermal sensor is configured to have a field of view that includes both the fluid stream and the fluid bath; and a controller in operational communication with the thermal sensor and the water supply, the controller configured to:

obtain a fluid temperature of the fluid stream or the fluid bath using the thermal sensor;

compare the fluid temperature to a preset temperature; and adjust the water supply in response to comparing the fluid temperature to the preset temperature.

2. The washing machine appliance of claim 1, wherein the thermal sensor is further configured to obtain temperature data of the fluid bath.

3. The washing machine appliance of claim 2, wherein the controller is further configured to obtain the fluid temperature by analyzing the temperature data to determine at least two temperature values of the fluid bath and average the at least two temperature values of the fluid bath to determine the fluid temperature.

4. The washing machine appliance of claim 2, wherein the controller is further configured to:

determine that a fluid level of the fluid bath is above the basket bottom; and obtain the fluid temperature of the fluid bath when the fluid level is above the basket bottom.

5. The washing machine appliance of claim 2, wherein the controller is further configured to:

determine that a fluid level of the fluid bath is above the basket bottom;

obtain temperature data of the fluid stream and temperature data of the fluid bath; and obtain the fluid temperature by averaging the temperature data of the fluid bath and the temperature data of the fluid stream.

6. The washing machine appliance of claim 2, wherein the controller is further configured to:

determine that a fluid level of the fluid bath is above the basket bottom; and obtain the fluid temperature by averaging a plurality of temperature values of the fluid bath and a plurality of temperature values of the fluid stream.

7. The washing machine appliance of claim 1, wherein the thermal sensor is an infrared camera.

8. The washing machine appliance of claim 1, wherein the thermal sensor is located on an inner surface of the door or on an inner surface of the cabinet.

9. The washing machine appliance of claim 1, wherein the controller is further configured to obtain the fluid temperature by analyzing the temperature data to determine at least two temperature values of the fluid stream and average the at least two temperature values of the fluid stream to determine the fluid temperature.

10. The washing machine appliance of claim 1, wherein the controller is further configured to:

determine that a fluid level of the fluid bath is below the basket bottom; and obtain the fluid temperature of the fluid stream when the fluid level is below the basket bottom.

11. The washing machine appliance of claim 1, wherein the water supply includes a cold water valve and a hot water valve, wherein the controller is further configured to adjust the water supply in response to comparing the fluid temperature to a preset temperature value by turning on the cold water valve when the fluid temperature is above the preset temperature value, and wherein the controller is further configured to adjust the water supply in response to comparing the fluid temperature to the preset temperature by turning on the hot water valve when the fluid temperature is below the preset temperature value.

12. A washing machine fluid temperature measurement method for measuring fluid entering a wash tub of a washing machine appliance in a fluid stream, the wash tub housing a wash basket therein, the method comprising the steps of:

operating a water supply to provide a wash fluid as a fluid stream into the wash basket, the wash fluid collected in the wash tub as a fluid bath;

obtaining a fluid temperature of the fluid stream or the fluid bath using a thermal sensor directed at the fluid stream or the fluid bath, wherein the thermal sensor is configured to have a field of view that includes both the fluid stream and the fluid bath;

comparing the fluid temperature to a preset temperature; and adjusting the water supply to the wash basket in response to comparing the fluid temperature to the preset temperature.

13. The method of claim 12, wherein the thermal sensor is further directed at a basket bottom of the wash basket to obtain a fluid temperature of the fluid bath.

14. The method of claim 13, wherein the step of obtaining the fluid temperature using the thermal sensor further comprises:

determining that a fluid level of the fluid bath is above the basket bottom; and receiving temperature data for more than one location of the fluid bath.

15. The method of claim 13, wherein the step of obtaining the fluid temperature using the thermal sensor further comprises:

determining a fluid level of the fluid bath is below the basket bottom;

analyzing temperature data to determine a plurality of temperature values from a plurality of locations along the fluid stream;

determining the fluid level of the fluid bath is above the basket bottom; and analyzing temperature data to determine a plurality of temperature values from a plurality of locations of the fluid bath.

16. The method of claim 15, wherein analyzing temperature data further comprises averaging the plurality of temperature values from either the fluid stream or the fluid bath to determine an average fluid temperature, and wherein the step of comparing the fluid temperature to the preset temperature further comprises comparing the average fluid temperature to the preset temperature.

17. The method of claim 12, wherein obtaining the fluid temperature using the thermal sensor further comprises:

receiving temperature data from the thermal sensor, analyzing the temperature data to determine at least one temperature value for the fluid stream.

18. The method of claim 12, wherein the step of obtaining the fluid temperature using the thermal sensor further comprises receiving temperature data for more than one location along the fluid stream.

19. The method of claim 12, wherein the water supply comprises a cold water valve and a hot water valve, and wherein the step of adjusting the water supply to the wash basket in response to comparing the fluid temperature to the preset temperature further comprises turning on the cold water valve when the fluid temperature is above the preset temperature and turning on the hot water valve when the fluid temperature is below the preset temperature.

* * * * *